United States Patent [19]

Beisenherz et al.

[11] Patent Number: 5,073,254

[45] Date of Patent: Dec. 17, 1991

[54] CYLINDRICAL SCREENING BASKET

[75] Inventors: Kurt Beisenherz, Regensburg; Waldemar R. Knodel, Pentling, both of Fed. Rep. of Germany

[73] Assignee: Heinrich Fiedler GmbH & Co. KG, Regensburg, Fed. Rep. of Germany

[21] Appl. No.: 566,979

[22] Filed: Aug. 14, 1990

[30] Foreign Application Priority Data

Aug. 16, 1989 [DE] Fed. Rep. of Germany ..... 3927202

[51] Int. Cl.[5] ..... B07C 1/20; B01D 39/10

[52] U.S. Cl. ..... 209/273; 209/397; 210/413; 210/498

[58] Field of Search ..... 209/268, 273, 397; 210/413, 498; 162/55

[56] References Cited

U.S. PATENT DOCUMENTS

| | | | |
|---|---|---|---|
| 4,529,520 | 7/1985 | Lampenius | 209/397 X |
| 4,812,229 | 3/1989 | Tra | 209/273 X |
| 4,880,540 | 11/1989 | Frejborg | 209/273 X |
| 4,950,402 | 8/1990 | Frejborg | 209/273 X |

FOREIGN PATENT DOCUMENTS 3400423 7/1984 Fed. Rep. of Germany .

OTHER PUBLICATIONS

"*Webster's Universal Dictionary of the English Language*", vol. II, p. 1830, The World Syndicate Publishing Company, N.Y., 1936.

*Primary Examiner*—Michael S. Huppert
*Assistant Examiner*—Edward M. Wacyra
*Attorney, Agent, or Firm*—Henry M. Feiereisen

[57] ABSTRACT

A cylindrical screening basket for sorting and classifying fiber suspensions includes a wall which has an inner wall surface facing the fiber suspension and is provided with screen openings which lead into grooves arranged at the inner wall surface. The grooves extend essentially parallel to each other and transversely to the flow direction of the fiber suspension and are arched to define a downstream flank and an upstream flank, with the downstream flank having a sharper curvature than the upstream flank.

23 Claims, 2 Drawing Sheets

CYLINDRICAL SCREENING BASKET

BACKGROUND OF THE INVENTION

The present invention refers to a cylindrical screening basket or basket strainer, and in particular to a screening basket for classifying fiber suspensions.

German patent DE-PS 34 00 423 describes a screening basket for classifying fiber suspensions which includes a perforated cylinder wall, with the screen openings being associated at the inside to a rotor and leading into grooves which are arranged at the suspension flow near surface of the screening basket and extend essentially transversely to the flow direction of the fiber suspension. A screening basket of this type desires to prevent an increase of the flow resistance of the screen; however, the attained sorting or classification remains unsatisfactory and thus the overall efficiency of the classification is also unsatisfactory. Same is true in case the strainer surface has a symmetrical, waved configuration.

SUMMARY OF THE INVENTION

It is thus an object of the present invention to provide an improved screening basket obviating the afore-stated drawbacks.

In particular, it is an object of the present invention to provide an improved screening basket attaining a high efficiency and quality of classification of the fiber suspensions.

These objects and others which will be apparent hereinafter are attained in accordance with the present invention by a wall which has an inner wall surface facing the fiber suspension and is provided with screen openings which lead into grooves arranged at the inner wall surface, with the grooves extending essentially transversely to the flow direction of the fiber suspension and being arched to define a downstream flank and an upstream flank, with the downstream flank having a sharper curvature than the upstream flank.

By designing the grooves with curved configuration, the screening basket permits optimal flow conditions, a high flow velocity and superior throughput because the shape of the grooves is free from discontinuities or irregularities in form of e.g. edges or corners which would brake the flow. Preferably, the juncture of the inner wall surface with the grooves is preferably rounded in order to avoid sharp edges or corners also in these areas. Thus, the grooves are reliably rinsed, and fibers are prevented from clinging to any edges or corners.

The overall width of the grooves is divided into two sections by the center line of the screen openings, with one section extending from the juncture of the downstream flank with the inner wall surface to the center line and with the other section extending from the center line to the juncture of the upstream flank with the inner wall surface. Depending on the circumstances and applications, the screen openings may extend into the base, i.e. deepest point of the grooves or may extend into either of the flanks. When leading into the base, the width ratio of the one section to the other section should be about 1:2 to 1:4. In case, the screen openings extend into the upstream flank, the width ratio should be about 1:1 to 4:1.

BRIEF DESCRIPTION OF THE DRAWING

The above and other objects, features and advantages of the present invention will now be described in more detail with reference to the accompanying drawing in which.

DETAILED DESCRIPTION OF PREFERRED EMBODIMENTS

Figure 1:
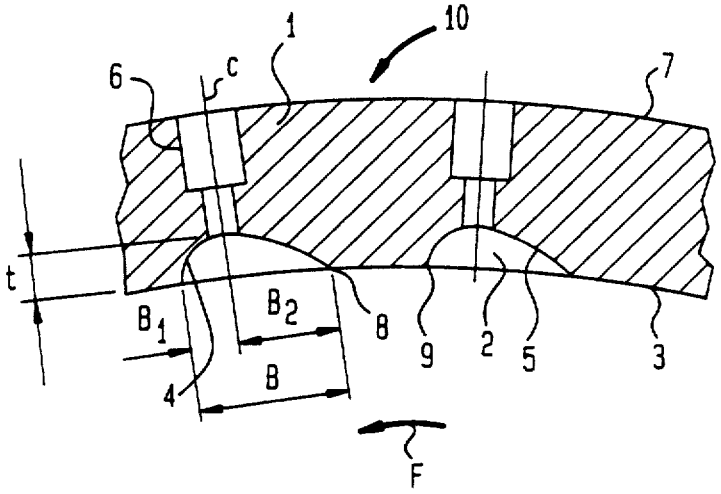
FIG. 1 is a schematic and simplified sectional view through an exemplified wall section of a first embodiment of a screening basket according to the invention.
Figure 4:
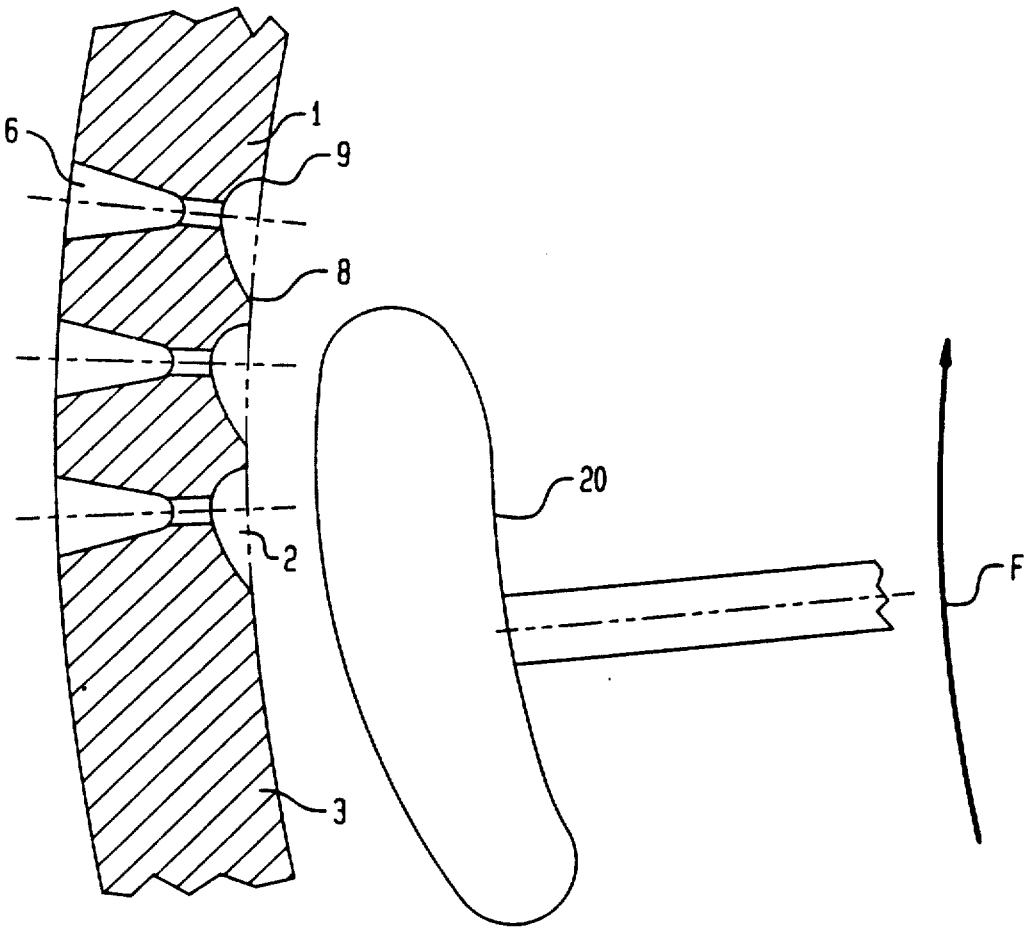
FIG. 4 is a fragmentary partly sectional view of the screening basket of FIG. 1 together with a rotor of which only one rotor arm with blade is illustrated.

Referring now to the drawing, and in particular to FIG. 1, there is shown a schematic and simplified sectional view of a first embodiment of a cylindrical screening basket or basket strainer in accordance with the present invention for classifying and sorting fiber suspensions. For ease of illustration only a wall section of the screening basket is depicted in detail in order to describe the essential features of the present invention. It will be appreciated by persons skilled in the art that the screening basket contains more mechanical apparatus which does not appear in the foregoing Figures or is shown only schematically. For example, the screening basket includes a rotor such as rotor 20 which is schematically shown in FIG. 4 through illustration of only one rotor arm with rotor blade for sake of simplicity; by which the fiber suspensions are advanced toward the screen openings. However, this apparatus, like other necessary apparatus, is not part of the invention, and apart from the rotor 20 has been omitted from the Figures for the sake of simplicity.

Figure 2:
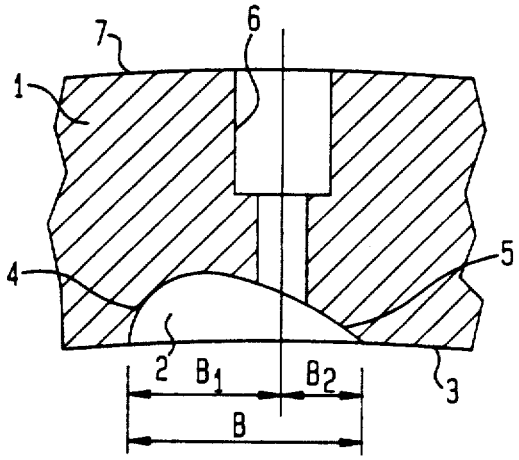
FIG. 2 is a schematic and simplified sectional view through an exemplified wall section of a second embodiment of a screening basket according to the invention.

The screening basket is generally designated by reference numeral 10 and includes a cylindrical wall 1 of which only a section is shown. At the inner wall surface 3, the screening basket 10 is provided with grooves 2 which are oriented parallel to the longitudinal axis of the screening basket 10 and thus extend transversely to the flow direction of the fiber suspension as indicated by arrow F. The grooves 2 extend from the wall surface 3 inwardly into the wall 1 and, with reference to the flow direction of the fiber suspension, are defined by a downstream flank 4 of sharp curvature and an upstream flank 5 of lesser or slight curvature. Extending between the grooves 2 and the outer wall surface 7 of the screening basket 10 are radial screen openings or bores 6 which are spaced about the cylindrical wall 4 and, in the non-limiting example of FIG. 1, are shown of step-shaped configuration. In the embodiment of FIG. 1, each screen opening 6 is connected to the pertaining groove 2 at its deepest part or base while in the embodiment as shown in FIG. 2, each screen opening 6 leads into the flank 5. It will be readily recognized that depending on the circumstances, the screen openings 6 may certainly also extend into the flank 4.

Preferably, the juncture 8 and 9 of the grooves 2 with the inner wall surface 3 of the screening basket 10 is suitably rounded to avoid sharp edges or corners.

In FIG. 1, the overall width of each groove 2 is designated by the reference character B and is divided into a section B1 and a section B2 by a radially extending center line C of the screen opening 6. The depth of the groove 2 is designated by the reference character t. The width ratio B1 to B2 in the embodiment of the screening basket as shown in FIG. 1, in which the screen openings 6 extend into the base of the grooves 2, is in the range of about 1:2 to 1:4. In the embodiment of the screening basket as shown in FIG. 2, in which the screen openings 6 extend into the upstream flank 5, the width ratio B1 to B2 ranges from about 1:1 to 4:1. The depth t of the groove 2 depends on the fiber suspension being treated, and may range from about 0.3–3 mm, and is preferably at about 1 mm. The overall width B depends on the spacing between the screen openings 6, and may range from about 2–5 mm.

Figure 3:
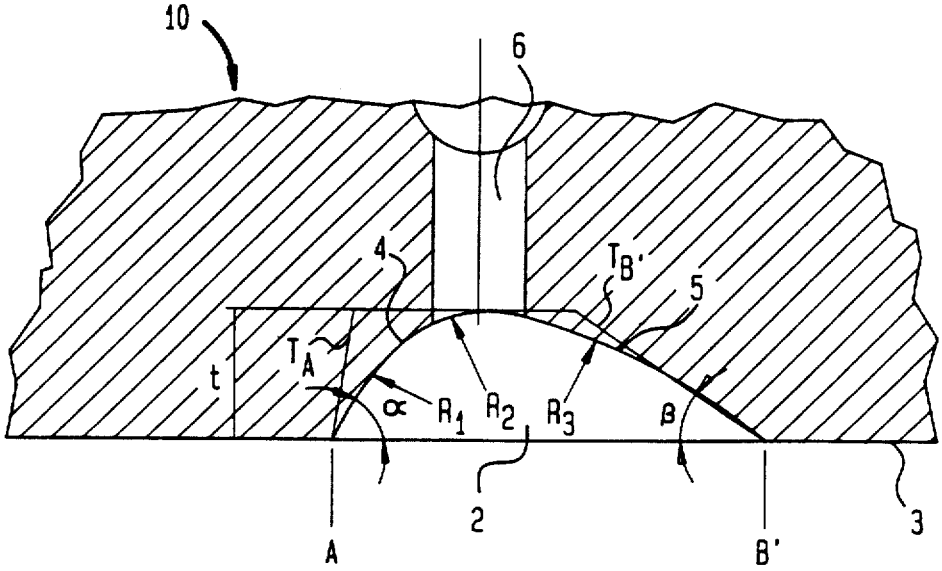
FIG. 3 is a sectional view of the screening basket of FIG. 1 on an enlarged scale and illustrating in detail the configuration and shape of a groove.

Turning now to FIG. 3 there is shown a sectional view of the screening basket 10 of FIG. 1 on an enlarged scale to illustrate in detail the shape or configuration of an exemplified groove 2. The downstream flank 4 which is of sharper curvature is smoothly and continuously connected with the upstream flank 5 by an arched transition which is defined by a radius R2. The radius of curvature R1 of the downstream flank 4 ranges from about 4–6 mm, and preferably is about 5 mm while the radius of curvature R3 of the upstream flank 5 ranges from about 8–12 mm, and preferably is about 10 mm. The radius of curvature R2 of the arched transition R2 between the flanks 4 and 5 ranges from about 0.2 to 0.8 mm, and preferably is about 0.5 mm.

As illustrated in FIG. 3, the flanks 4 and 5 intersect the cylindrical inner wall surface 3 of the screening basket 10 in points A and B' which suitably may be rounded there to avoid any sharp edges or corners. The flank 4 intersects the inner wall surface 3 at an angle $\alpha$, and the flank 5 describes with the inner wall surface 3 an angle $\beta$. As further illustrated in FIG. 3, the angle $\alpha$ extends between the inner wall surface 3 and the tangent $T_A$ to the flank 4 in point A. Likewise, the angle $\beta$ extends between the inner wall surface 3 and the tangent $T_{B'}$ to the flank 5 in the point B'. Suitably, the angles $\alpha$ and $\beta$ range from 20° to 85°, with angle $\alpha$ lying preferably in a range between 75° and 85°, preferably at about 83°, and angle $\beta$ ranging preferably from 30°–45°, preferably at 37°.

While the invention has been illustrated and described as embodied in a screening basket, it is not intended to be limited to the details shown since various modifications and structural changes may be made without departing in any way from the spirit of the present invention.

What is claimed as new and desired to be protected by Letters Patent is set forth in the appended claims.

We claim:

1. A screening basket for classifying fiber suspensions; comprising a wall which has an inner wall surface facing the fiber suspension and includes screen openings leading into grooves provided at said inner wall surface, said grooves extending essentially transversely to the flow direction of the fiber suspension and being arched to define a downstream flank and an upstream flank, with said downstream flank having a sharper curvature than said upstream flank, said downstream flank and said upstream flank extending relative to said inner wall surface at an angle of less than 90° and defining with said inner wall surface a juncture edge of rounded configuration.

2. A screening basket as defined in claim 1 wherein said downstream and upstream flanks are smoothly joined with each other by a circular arc.

3. A screening basket as defined in claim 2 wherein said circular arc between said downstream flank and said upstream flank is defined by a radius of curvature ranging from about 0.2 to 0.8 mm.

4. A screening basket as defined in claim 3 wherein said circular arc between said downstream flank and said upstream flank is defined by a radius of curvature of about 0.5 mm.

5. A screening basket as defined in claim 1 wherein said grooves define a base, said screen openings extending essentially into said base of said grooves.

6. A screening basket as defined in claim 1 wherein said screen openings extend into said upstream flanks and define a center line dividing said grooves into first and second sections, said first and second sections being defined by a width ratio ranging from about 1:1 to 4:1.

7. A screening element as defined in claim 6 wherein said first section extends from a juncture of said downstream flank with said inner wall surface to the center line, and said second section extends from the center line to a juncture of said upstream flank with said inner wall surface.

8. A screening basket as defined in claim 1 wherein said grooves are connected to said inner wall surface via a juncture, with said juncture being rounded.

9. A screening basket as defined in claim 8 wherein said inner wall surface and a tangent to said upstream flank in a juncture point between said inner wall surface and said upstream flank defines an angle in the range of 20° to 85°.

10. A screening basket as defined in claim 9 wherein said angle ranges from 30° to 45°.

11. A screening basket as defined in claim 10 wherein said angle is 37°.

12. A screening basket as defined in claim 1 wherein said downstream flank has a width and said upstream flank has a width, with the width of said downstream flank being 1:2 to 1:4 of the width of said upstream flank.

13. A screening basket as defined in claim 1 wherein each of said grooves has a depth and a width, with the depth being about $\frac{1}{3}$ to about $\frac{1}{2}$ of the width of said groove.

14. A screening basket as defined in claim 13 wherein the depth of said grooves is about 0.3 to 3 mm.

15. A screening basket as defined in claim 14 wherein the depth of said grooves is about 1 mm.

16. A screening basket as defined in claim 1 wherein said downstream flank is defined by a radius of curvature ranging from about 4 to 6 mm.

17. A screening basket as defined in claim 16 wherein said downstream flank is defined by a radius of curvature of about 5 mm.

18. A screening basket as defined in claim 1 wherein said upstream flank is defined by a radius of curvature ranging from about 8 to 12 mm.

19. A screening basket as defined in claim 18 wherein said downstream flank is defined by a radius of curvature of about 10 mm.

20. A screening basket as defined in claim 1 wherein said inner wall surface and a tangent to said downstream flank in a juncture point between said inner wall surface and said downstream flank defines an angle in the range of 20° to 85°.

21. A screening basket as defined in claim 20 wherein said angle ranges from 75° to 85°.

22. A screening basket as defined in claim 21 wherein said angle is 83°.

23. A screening basket for classifying fiber suspensions; comprising:

a cylindrical wall having an inner wall surface which faces the fiber suspension and being provided with screen openings; and rotor means for advancing the fiber suspensions toward said screen openings, said screen opening leading into grooves arranged at said inner wall surface, with said grooves extending essentially transversely to the flow direction of the fiber suspension and being arched to define a downstream flank and an upstream flank, with said downstream flank having a sharper curvature than said upstream flank, said downstream flank and said upstream flank extending relative to said inner wall surface at an angle of less than 90° and defining with said inner wall surface a juncture edge of rounded configuration.

* * * * *